US012584260B2

(12) United States Patent
Dunn et al.

(10) Patent No.: US 12,584,260 B2
(45) Date of Patent: Mar. 24, 2026

(54) COMBINATION WASHER/DRYER CYCLE FOR A RECREATIONAL VEHICLE

(71) Applicant: Haier US Appliance Solutions, Inc., Wilmington, DE (US)

(72) Inventors: David Scott Dunn, Louisville, KY (US); Jivko Ognianov Djerekarov, Louisville, KY (US); Aaron Lee Welch, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 170 days.

(21) Appl. No.: 18/404,440

(22) Filed: Jan. 4, 2024

(65) Prior Publication Data

US 2025/0223743 A1 Jul. 10, 2025

(51) Int. Cl.

| | |
|---|---|
| ***D06F 33/72*** | (2020.01) |
| ***D06F 33/62*** | (2020.01) |
| ***D06F 101/20*** | (2020.01) |
| ***D06F 103/42*** | (2020.01) |
| ***D06F 105/06*** | (2020.01) |
| ***D06F 105/08*** | (2020.01) |
| ***D06F 105/52*** | (2020.01) |

(52) U.S. Cl.

CPC ..... *D06F 33/72* (2020.02); *D06F 33/62* (2020.02); *D06F 2101/20* (2020.02); *D06F 2103/42* (2020.02); *D06F 2105/06* (2020.02); *D06F 2105/08* (2020.02); *D06F 2105/52* (2020.02)

(58) Field of Classification Search

CPC ..... D06F 25/00; D06F 33/72; D06F 39/20

See application file for complete search history.

(56) References Cited

U.S. PATENT DOCUMENTS

| | | | | |
|---|---|---|---|---|
| 10,508,376 | B2 | 12/2019 | Mamiya | |
| 2012/0011659 | A1* | 1/2012 | Park | D06F 33/38 68/12.13 |
| 2017/0073877 | A1 | 3/2017 | Hettinger et al. | |
| 2020/0370226 | A1 | 11/2020 | Scheible et al. | |
| 2022/0243382 | A1 | 8/2022 | Woo et al. | |
| 2022/0298707 | A1* | 9/2022 | Ekbundit | D06F 39/001 |
| 2024/0271349 | A1* | 8/2024 | Bae | D06F 33/38 |

FOREIGN PATENT DOCUMENTS

| | | | | |
|---|---|---|---|---|
| CN | 115216914 | A | 10/2022 | |
| DE | 102021132624 | A1 * | 6/2023 | D06F 39/20 |
| JP | 2021186184 | A * | 12/2021 | D06F 34/05 |

OTHER PUBLICATIONS

JP2021186184A Machine Translation (Year: 2021).*
DE102021132624A1 Machine Translation (Year: 2023).*

* cited by examiner

*Primary Examiner* — Spencer E. Bell
(74) *Attorney, Agent, or Firm* — Dority & Manning, P.A.

(57) ABSTRACT

A combination washer/dryer laundry appliance includes a recirculating process air flow system in fluid communication with a conditioning system for dehumidification and heating of the process air. The laundry appliance may be adaptable for use in a recreational vehicle with a water conservation mode setting for one or more laundry cycles. In the conservation mode, condensate water from a prior drying cycle is stored in a sump for use in a subsequent wash cycle.

18 Claims, 5 Drawing Sheets

COMBINATION WASHER/DRYER CYCLE FOR A RECREATIONAL VEHICLE

FIELD OF THE INVENTION

The present disclosure relates generally to combination washer and dryer laundry appliances, in particular a combination washer and dryer laundry appliance with a water saving mode suitable for recreational vehicles.

BACKGROUND OF THE INVENTION

Recreational vehicles (RVs) typically carry both fresh water for general use and waste water. Waste water may be generally classified as either grey water, which may be reused for some applications, and black water which cannot. Fresh water, grey water, and black water are carried in the RV in separate holding tanks which account for significant space and weight making water a concern for RV consumers. Accordingly efficient use of water is desirable for RV appliances.

Space may also be a concern for RV consumers. Although a full-size washer/dryer pair of appliances may be desirable, the space required for a full-size washer and dryer may not be available in RVs. A space-saving combination washer and dryer laundry appliance can be an attractive option. Improvements to water efficiency in combination washer and dryer laundry appliances may address some of the above concerns of RV users, making them more useful in some cases.

Accordingly, improvements to water efficiency for combination washer and dryer laundry appliances suitable for RVs are desirable.

BRIEF DESCRIPTION OF THE INVENTION

Aspects and advantages of the invention will be set forth in part in the following description, may be apparent from the description, or may be learned through practice of the invention.

In one exemplary aspect, a laundry appliance comprises a tub positioned within a cabinet, a laundry basket supported for rotation within the tub, the laundry basket defining a chamber for receipt of laundry articles for washing and drying, and a conditioning system comprising a dehumidification section and a heating section. A recirculating process air flow system provides fluid communication between the chamber and the conditioning system, wherein the recirculating process air flow system, the conditioning system, and the laundry basket define a process air flow path. The laundry appliance further comprises a fan operable to move a flow of process air through the process air flow path, a condensate line, and a controller storing a set of standard laundry profiles. The controller is configured to receive a command to initiate a conservation mode for modifying the set of standard laundry profiles and implement a responsive action to reduce water consumption of the laundry appliance.

In another exemplary aspect, a method of operating a laundry appliance is presented. The laundry appliance comprises a tub positioned within a cabinet, a laundry basket supported for rotation within the tub, a drain pump fluidly coupling a sump with a waste, a conditioning system comprising a dehumidification section, and a controller storing a set of standard laundry profiles and configured to perform the set of standard laundry profiles. The method comprises receiving a command to initiate a conservation mode for the set of standard laundry profiles, and implementing a responsive action to reduce water consumption of the laundry appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
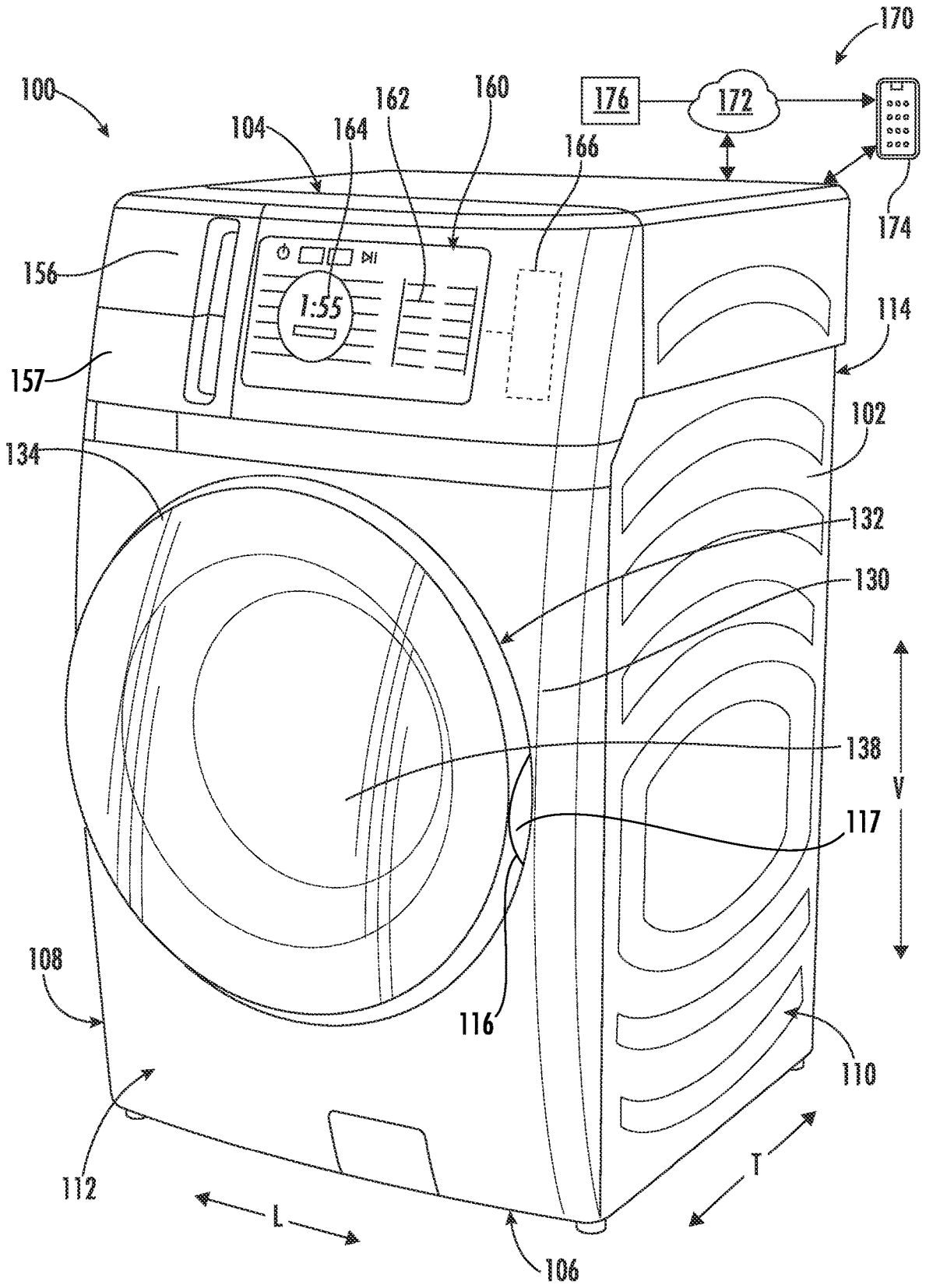
FIG. 1 provides a front perspective view of an exemplary combination washer and dryer laundry appliance in accordance with embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
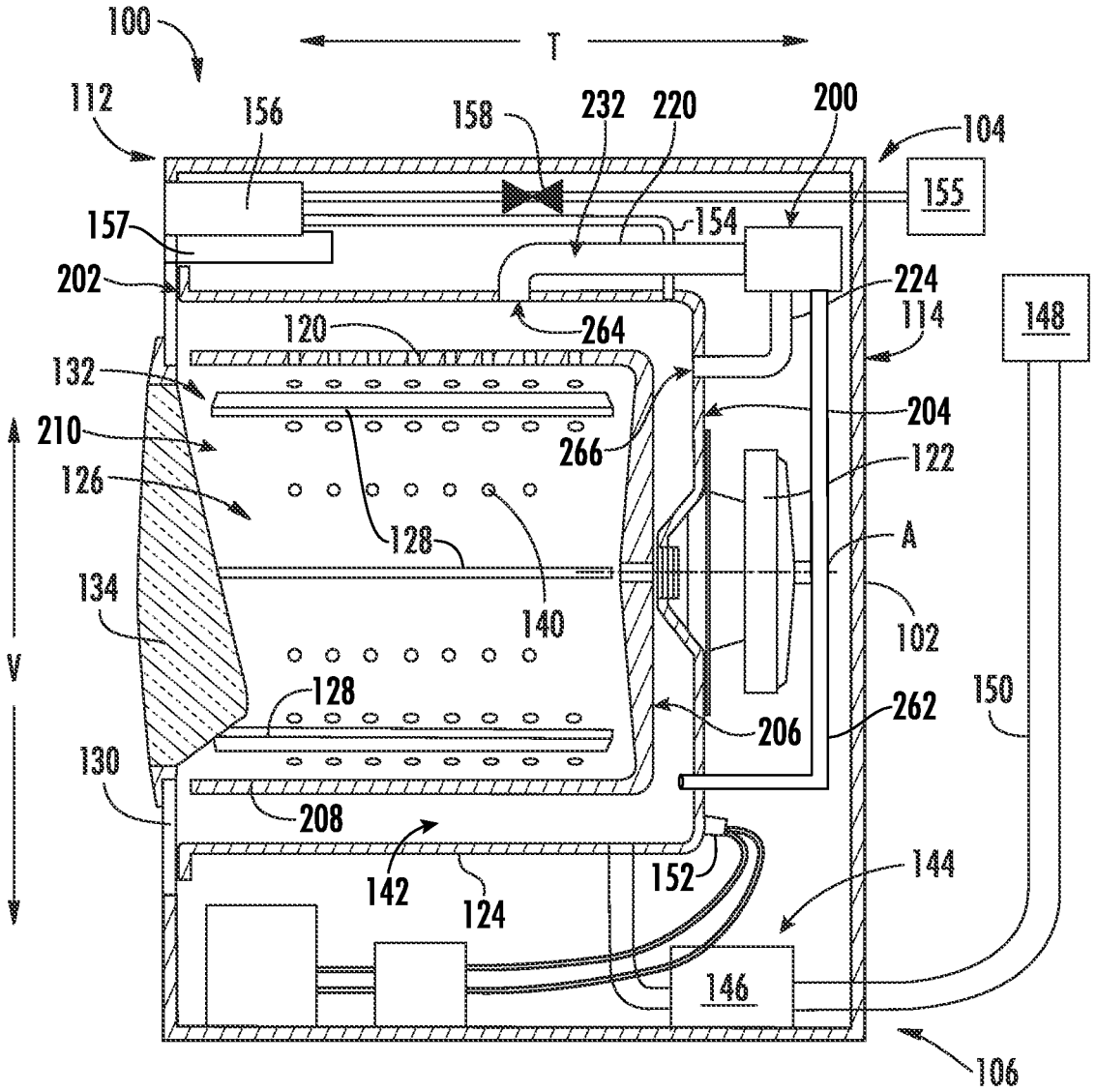
FIG. 2 provides a side cross-sectional view of the exemplary laundry appliance of FIG. 1.
Figure 3:
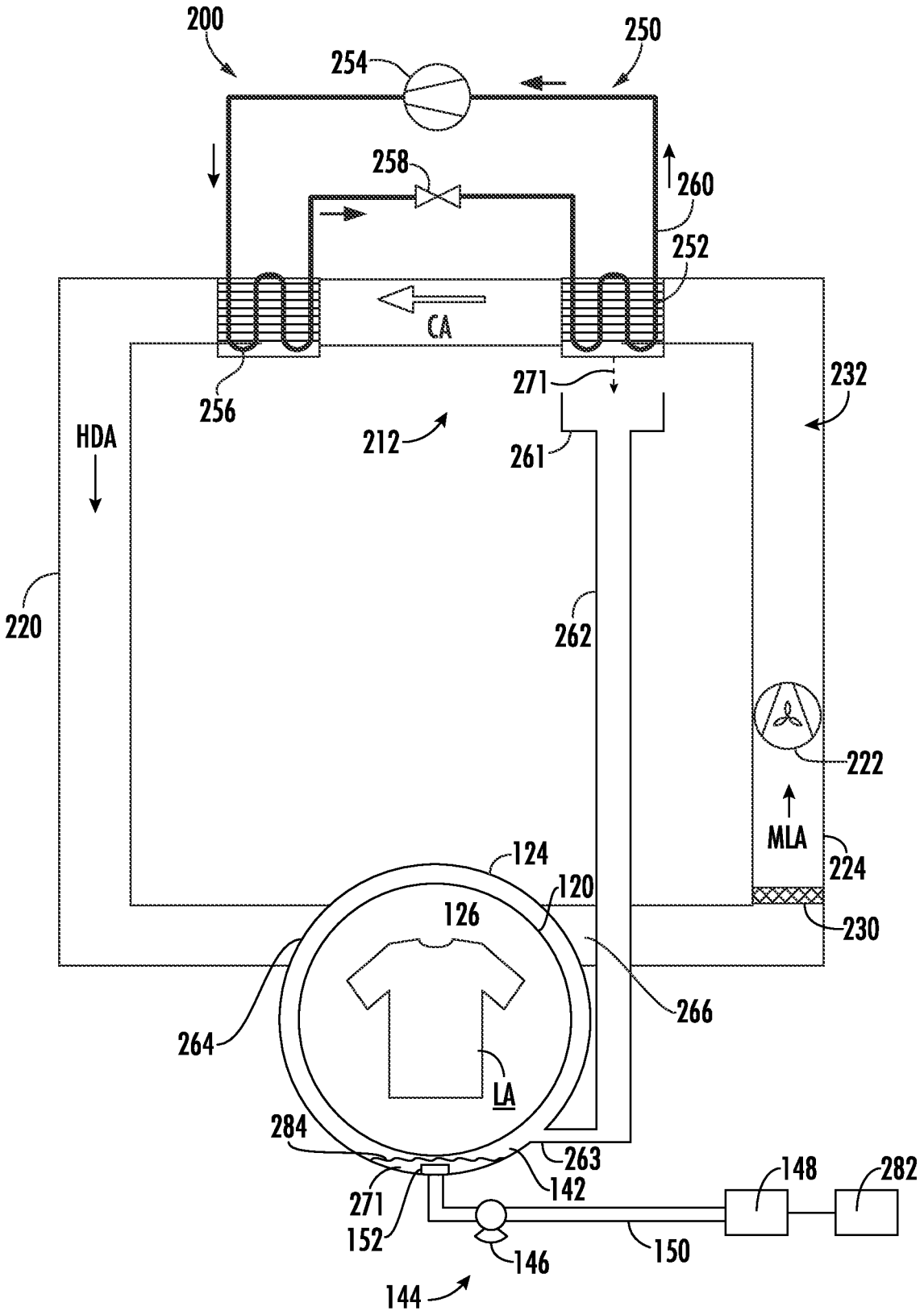
FIG. 3 provides a schematic diagram of an exemplary heat pump dryer appliance and a conditioning system thereof in accordance with exemplary embodiments of the present disclosure.
Figure 4:
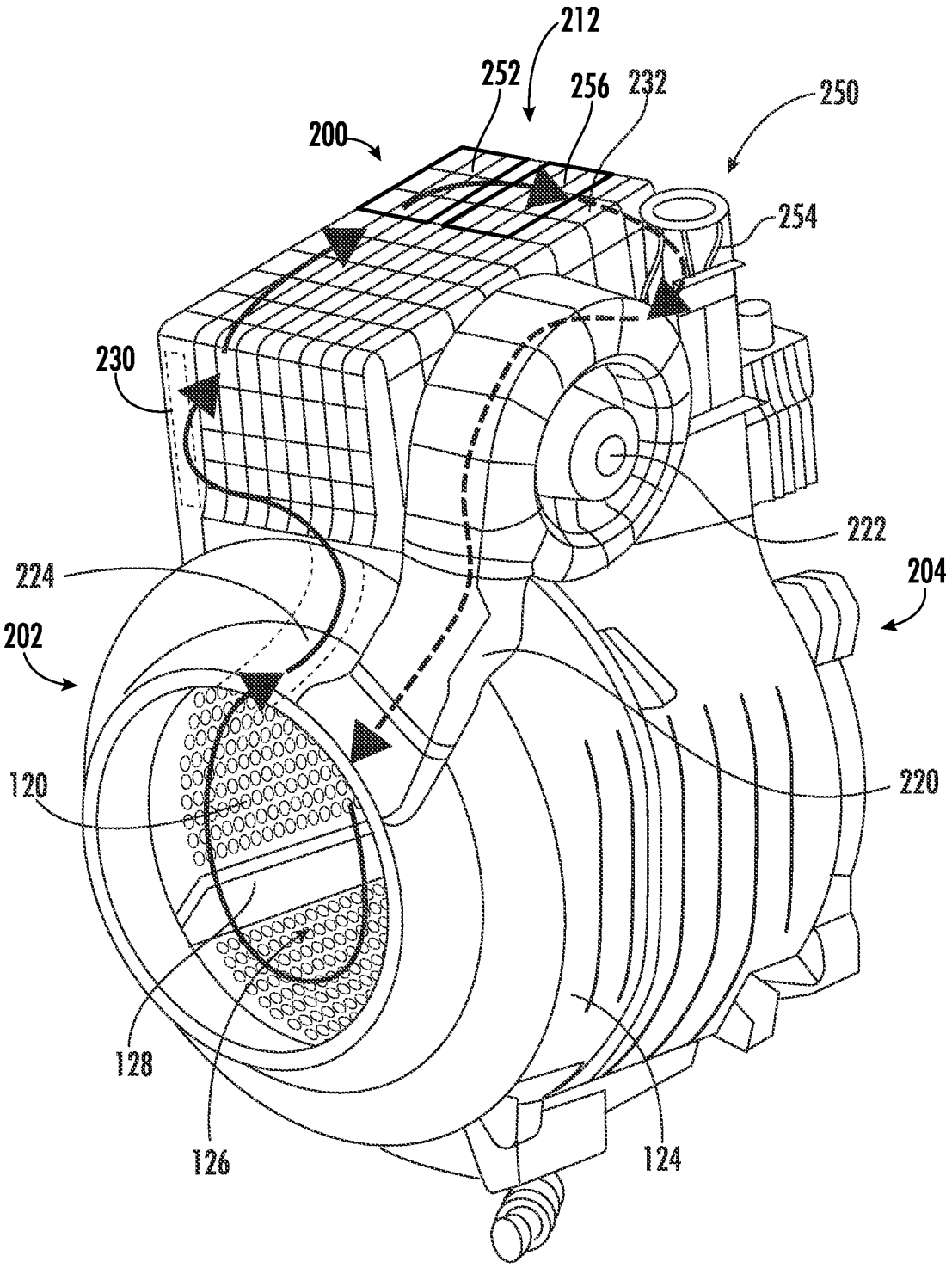
FIG. 4 provides a perspective view of the example laundry appliance of FIG. 1 with a cabinet of the laundry appliance removed to reveal certain components of the dryer appliance.

Referring now to the figures, an exemplary laundry appliance that may be used to implement aspects of the present subject matter will be described. Specifically, FIG. 1 is a perspective view of an exemplary horizontal axis washer and condenser dryer combination appliance 100, referred to herein for simplicity as laundry appliance 100. FIG. 2 is a side cross-sectional view of the exemplary laundry appliance of FIG. 1. FIG. 3 provides a schematic diagram of an exemplary heat pump dryer appliance and a conditioning system thereof in accordance with exemplary embodiments of the present disclosure. FIG. 4 is a perspective view of laundry appliance 100 with cabinet 102 removed. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIGS. 2 and 3, a laundry basket 120 is rotatably mounted (i.e., supported for rotation) within cabinet 102 such that it is rotatable about axis of rotation A. According to the illustrated embodiment, axis of rotation A is substantially parallel to the horizontal direction (e.g., the transverse direction T), as this exemplary appliance is a front load appliance. A motor 122, e.g., such as a pancake motor, is in mechanical communication with laundry basket 120 to selectively rotate laundry basket 120 (e.g., during an agitation or a rinse cycle, or a dryer cycle of laundry appliance 100). Motor 122 may be mechanically coupled to laundry basket 120 directly or indirectly, e.g., via a pulley and a belt (not pictured). Laundry basket 120 is received within a tub 124 that defines a chamber 126 that is configured for receipt of articles for washing or drying.

As used herein, the terms "clothing" or "articles" includes but need not be limited to fabrics, textiles, garments, linens, papers, or other items which may benefit form a laundry operation (i.e., wash and dry cycles). Furthermore, the term "load" or "laundry load" refers to the combination of clothing or similar articles that may be washed together and/or dried together in laundry appliance 100 (e.g., the combination washer and condenser dryer) and may include a mixture of different or similar articles of clothing of different or similar types and kinds of fabrics, textiles, garments and linens within a particular laundering process.

The tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIGS. 2 and 3, a plurality of ribs 128 extends from laundry basket 120 into chamber 126. In this manner, for example, ribs 128 may lift articles disposed in laundry basket 120 and then allow such articles to tumble back to a bottom (i.e., a vertically lower portion) of laundry basket 120 as it rotates. Ribs 128 may be mounted to laundry basket 120 such that ribs 128 rotate with laundry basket 120 during operation of laundry appliance 100.

Referring generally to FIGS. 1 through 3, cabinet 102 also includes a front panel 130 which defines an opening 132 that permits user access to laundry basket 120 and tub 124. More specifically, laundry appliance 100 includes a door 134 that is positioned over opening 132 and is rotatably mounted to front panel 130. In this manner, door 134 permits selective access to opening 132 by being movable between an open position (not shown) facilitating access to a tub 124 and a closed position (FIG. 1) prohibiting access to tub 124. Laundry appliance 100 may further include a latch assembly for selectively locking door 134 in the closed position. The latch assembly may be desirable, for example, to ensure and verify that door 134 is securely closed during certain operating cycles or events.

A window 138 in door 134 may be provided to permit viewing of laundry basket 120 when door 134 is in the closed position, e.g., during operation of laundry appliance 100. Door 134 also includes a handle 116, formed as an undercut 117 in the perimeter of the door 134 that a user may grasp when opening door 134. Further, although door 134 is illustrated as mounted to front panel 130, it should be appreciated that door 134 may be mounted to another side of cabinet 102 or any other suitable support according to alternative embodiments.

Referring to FIG. 2, laundry basket 120 also defines a plurality of perforations 140 in order to facilitate fluid communication between an interior of basket 120 (i.e., chamber 126) and tub 124. A sump 142 is defined by tub 124 at the bottom of tub 124 along the vertical direction V. Thus, sump 142 is configured for at least receipt of and generally collects wash fluid during operation of laundry appliance 100. For example, during operation of laundry appliance 100, wash fluid may be urged by gravity from laundry basket 120 to sump 142 through plurality of perforations 140.

A drain pump assembly 144 is located beneath tub 124 and is in fluid communication with sump 142 for periodically discharging soiled wash fluid from laundry appliance 100. Drain pump assembly 144 may generally include a drain pump 146 which is in fluid communication with sump 142 and with waste 148 through a drain hose 150. During a drain cycle, drain pump 146 urges a flow of wash fluid from sump 142, through drain hose 150, and to waste 148. More specifically, drain pump 146 includes a motor (not shown) which is energized during a drain cycle such that drain pump 146 draws wash fluid from sump 142 and urges it through drain hose 150 to waste 148. Waste 148 may be a wastewater storage and treatment system, such as a septic system or sanitary sewer, or may be a holding tank such as a grey water tank.

A spout 154 is configured for directing a flow of fluid into tub 124. For example, spout 154 may be in fluid communication with a water supply 155 (FIG. 2) in order to direct fluid (e.g., clean water or wash fluid) into tub 124. Spout 154 may also be in fluid communication with the sump 142. For example, pump assembly 144 may direct wash fluid collected in sump 142 to spout 154 in order to circulate wash fluid in tub 124.

As illustrated in FIGS. 1 and 2, a drawer including a bulk and manual detergent reservoir, detergent drawer 156, is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk fabric softener reservoir and dispenser, bulk reservoir 157, is disposed within cabinet 102 and is configured for receipt of a fluid additive, for example fabric softener, for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

In addition, a water supply valve or control valve 158 may provide a flow of water from a water supply source (such as a municipal water supply 155 or a water tank) into detergent dispenser 156 and/or into tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet 102. In addition, although control valve 158 is described herein as regulating the flow of "wash fluid," it should be appreciated that this term includes, water, detergent, other additives, or some mixture thereof.

A control panel 160 (FIG. 1) including a plurality of input selectors 162 may be coupled to front panel 130. Control panel 160 and input selectors 162 collectively form a user interface input for operator selection of machine cycles and features. For example, in an exemplary embodiment, a display 164 indicates selected features, a countdown timer, and/or other items of interest to machine users.

Operation of laundry appliance 100 is controlled by a processing device or controller 166 (FIG. 1) that is operatively coupled to control panel 160 for user manipulation to select laundry cycles and features. In response to user manipulation of control panel 160, controller 166 operates the various components of laundry appliance 100 to execute selected machine cycles and features.

Controller 166 may include a timer, one or more memory locations, and one or more microprocessors, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

Generally, during operation of laundry appliance 100, laundry items are loaded into laundry basket 120 through opening 132, and washing operation is initiated through operator manipulation of input selectors 162. Tub 124 is filled with water, detergent, and/or other fluid additives, e.g., via spout 154 and or detergent drawer 156. One or more valves (e.g., control valve 158) can be controlled by laundry appliance 100 to provide for filling laundry basket 120 to the appropriate level for the number of articles being washed and/or rinsed. By way of example for a wash mode, once laundry basket 120 is properly filled with fluid, the contents of laundry basket 120 can be agitated (e.g., with ribs 128) for washing of laundry items in laundry basket 120.

After the agitation phase of the wash cycle is completed, tub 124 can be drained using, for example, pump assembly 144. Laundry articles can then be rinsed by again adding fluid to tub 124, depending on the particulars of the cleaning cycle selected by a user. Ribs 128 may again provide agitation within laundry basket 120. One or more spin cycles may also be used. In particular, a spin cycle may be applied after the wash cycle and/or after the rinse cycle in order to wring wash fluid from the articles being washed. During a final spin cycle, laundry basket 120 is rotated at relatively high speeds and drain pump assembly 144 may discharge wash fluid from sump 142. After articles disposed in laundry basket 120 are cleaned, washed, and/or rinsed, the user can remove the articles from laundry basket 120, e.g., by opening door 134 and reaching into laundry basket 120 through opening 132. Alternately, a drying process may be initiated in embodiments comprising a combination washer/dryer laundry appliance. For example, after the articles disposed in laundry basket 120 are cleaned, washed, and/or rinsed, the user may manipulate the input selectors 162 to initiate a drying cycle.

Referring to FIG. 1, a schematic diagram of an external communication system 170 will be described according to an exemplary embodiment of the present subject matter. In general, external communication system 170 is configured for permitting interaction, data transfer, and other communications with laundry appliance 100. For example, this communication may be used to provide and receive operating parameters, user instructions or notifications, performance characteristics, user preferences, or any other suitable information for improved performance of laundry appliance 100.

External communication system 170 permits controller 166 of laundry appliance 100 to communicate wirelessly with external devices either directly or through a network 172. For example, an appliance user may use a consumer device 174 to communicate directly with laundry appliance 100. For example, consumer devices 174 may be linked in direct link or indirect link for communication with laundry appliance 100, e.g., directly through a local area network (LAN), Wi-Fi, Bluetooth, Zigbee, etc. or indirectly through a network link using network 172. In general, consumer device 174 may be any suitable device for providing and/or receiving communications or commands from a user. In this regard, consumer device 174 may include, for example, a personal phone, a tablet, a laptop computer, or another mobile device.

In addition, a remote server 176 may be in communication with (i.e., linked to) laundry appliance 100 and/or consumer device 174 through network 172. In this regard, for example, remote server 176 may be a cloud-based server 176, and is thus located at a distant location, such as in a separate state, country, etc. In general, communication between the remote server 176 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 172 can be any type of communication network. For example, network 172 can include one or more of a wireless network, a wired network, a personal area network, a local area network, a wide area network, the internet, or a cellular network, etc. According to an exemplary embodiment, consumer device 174 may communicate with a remote server 176 over network 172, such as the internet, to provide user inputs, receive user notifications or instructions, etc. In addition, consumer device 174 and remote server 176 may communicate with laundry appliance 100 to communicate similar information.

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Referring now specifically to FIGS. 2 through 4, features of a conditioning system, condenser system 200, for facilitating a drying process within laundry appliance 100 will be described in more detail. As illustrated, condensing system 200 may be mounted to tub 124 such that it is fluidly coupled to chamber 126. More specifically, as illustrated, laundry basket 120 extends between a front portion 202 and a back portion 204 of tub 124, e.g., along the transverse direction T. Laundry basket 120 also includes a back or rear wall 206, e.g., at back portion of laundry basket 120 or proximate back portion 204 of tub 124. Rear wall 206 of laundry basket 120 may be rotatably supported within cabinet 102 by a suitable bearing or may be fixed.

Laundry basket 120 is generally cylindrical in shape. Laundry basket 120 has an outer cylindrical wall 208 and a front flange or wall that defines an opening 210 of laundry basket 120, e.g., at, or adjacent to, front portion 202 of tub 124. As shown, opening 210 generally coincides with opening 132 of front panel 130 of cabinet 102, e.g., to provide user access to chamber 126 for loading and unloading of articles into and out of chamber 126 of laundry basket 120.

Conditioning system 200 may generally include a return duct 220 that is mounted to tub 124 for circulating process air (i.e., air used in a laundry process, for example the drying cycle) within chamber 126 to facilitate a drying process. For example, according to the illustrated exemplary embodiment, return duct 220 is fluidly coupled to tub 124 proximate a top of tub 124 (FIG. 2). Return duct 220 receives process air that has been heated and/or dehumidified by a heat exchanger 212 portion of conditioning system 200, the heat exchanger 212 comprising evaporator 252 and condenser 256. The return duct 220 provides the heated process air to laundry basket 120 via one or more holes defined by cylindrical wall 208 of laundry basket 120 (e.g., perforations 140). Accordingly, laundry appliance 100 comprises a recirculating process air flow system providing fluid communication between the chamber 126 and the conditioning system 200. Alternatively, the laundry appliance 100 may be referred to as a ventless system, as no vent is provided to allow an air flow to the outside.

Specifically, moisture laden, heated process air is drawn from laundry basket 120 by an air handler, such as a blower fan 222, which generates a negative air pressure within laundry basket 120 and a positive air pressure within return duct 220. According to the illustrated exemplary embodiment, laundry appliance 100 is a heat pump dryer appliance and thus conditioning system 200 may be a heat pump including a sealed refrigerant circuit, as described in more detail below with reference to FIGS. 3 and 4. Heated process air (with a lower moisture content than was received from laundry basket 120), exits conditioning system 200 and returns to laundry basket 120 by a return duct 220.

As shown, laundry appliance 100 may further include one or more lint filters 230 (FIGS. 3 and 4) to collect lint during drying processes. The moisture laden heated process air passes through intake duct 224 enclosing screen filter 230, which traps lint particles. More specifically, filter 230 may be placed into an air flow path 232 defined by laundry basket 120, conditioning system 200, intake duct 224, and return duct 220. Filter 230 may be positioned in the process air flow path 232 and may include a screen, mesh, or other material to capture lint in the process air flow 232. The location of lint filter 230 in laundry appliance 100 as shown in FIG. 3 is provided by way of example only, and other locations may be used as well. According to exemplary embodiments, lint filter 230 is readily accessible by a user of the appliance.

FIG. 3 provides a schematic view of laundry appliance 100 and depicts conditioning system 200 in more detail. FIG. 4 provides a perspective view of tub 124 with conditioning system 200 positioned on top of tub 124, with the cabinet 102 removed for clarity. For this embodiment, laundry appliance 100 is a heat pump dryer appliance and thus conditioning system 200 includes a sealed system 250. Sealed system 250 includes various operational components, which can be encased or located within a machinery compartment of laundry appliance 100. Generally, the operational components are operable to execute a vapor compression cycle for dehumidifying and heating process air passing through conditioning system 200. The operational components of sealed system 250 include an evaporator 252, a compressor 254, a condenser 256, and one or more expansion devices 258 connected in series along a refrigerant circuit or line 260. The evaporator 252 comprises a dehumidification section and the condenser 256 comprises a heating section of the conditioning system 200. Refrigerant line 260 is charged with a working fluid, which in this example is a refrigerant. Sealed system 250 depicted in FIG. 3 is provided by way of example only. Thus, it is within the scope of the present subject matter for other configurations of the sealed system to be used as well. As will be understood by those skilled in the art, sealed system 250 may include additional components, e.g., at least one additional evaporator, compressor, expansion device, and/or condenser.

In the below description, and elsewhere in this disclosure, various relative terms are used to describe temperature and moisture qualities of the process air at various locations along the airflow path 232. Generally, process air entering the heat exchanger 212 is moisture laden and cool or cooler than the process air exiting the heat exchanger 212. In particular, process air entering the evaporator 252 generally has more moisture (i.e., is more moisture laden) and is hotter than process air exiting the evaporator 252. Similarly, process air entering the condenser 256 is generally cooler than process air exiting the condenser 256. Accordingly, hot dry process air HDA refers to air leaving the heat exchanger 212 that is hotter and drier than the moisture laden process air MLA entering the heat exchanger 212.

In performing a drying cycle, one or more laundry articles LA may be placed within the chamber 126 of laundry basket 120. Hot dry process air HDA is supplied to chamber 126 via return duct 220 and tub inlet 264. The hot dry process air HDA enters chamber 126 of laundry basket 120 via a tub inlet 264 and perforations 140 in the cylindrical basket wall 208. The hot dry air HDA provided to chamber 126 causes moisture within laundry articles LA to evaporate. Accordingly, the process air within chamber 126 increases in water content and exits chamber 126 as warm moisture laden process air MLA. The warm moisture laden process air MLA exits chamber 126 through a tub outlet 266 defined by laundry basket 120 and flows into intake duct 224.

After exiting chamber 126 of laundry basket 120, the warm moisture laden process air MLA flows downstream to conditioning system 200. Blower fan 222 moves the warm moisture laden air MLA, as well as the process air more generally, through a process air flow path 232 defined by laundry basket 120, conditioning system 200, intake duct 224, and return duct 220. Thus, generally, blower fan 222 is operable to move process air through or along the process air flow path 232. The duct system includes all ducts that provide fluid communication (e.g., process airflow communication) between tub outlet 266 and conditioning system 200 and between conditioning system 200 and tub inlet 264. Although blower fan 222 is shown positioned between laundry basket 120 and conditioning system 200 along intake duct 224, it will be appreciated that blower fan 222 can be positioned in other suitable positions or locations along the duct system.

As further depicted in FIG. 3, the warm moisture laden process air MLA flows into or across evaporator 252 of the conditioning system 200. As the moisture laden process air MLA passes across evaporator 252, the temperature of the process air is reduced through heat exchange with refrigerant that is vaporized within evaporator 252. This vaporization process absorbs both the sensible and the latent heat from the moisture laden process air MLA, thereby reducing its temperature. As a result, moisture in the process air is condensed on the evaporator 252 and such condensate water 271 may be drained from conditioning system 200, e.g., using a condensate line 262. In the illustrative embodiment of FIGS. 3, 4, the condensate water 271 is directed into the tub 124, more particularly to the sump 142, using condensate line 262 which fluidly couples the conditioning system 200 with the tub 124. The condensate water 271 directed to the sump 142 may be used in a subsequent wash cycle as will be described below.

Process air passing over evaporator 252 becomes cooler than when it exited laundry basket 120 at tub outlet 266. As shown in FIG. 3, cool process air CA (cool relative to hot dry air HDA and moisture laden air MLA) flowing downstream of evaporator 252 is subsequently caused to flow across condenser 256, which condenses refrigerant therein. The refrigerant enters condenser 256 in a gaseous state at a relatively high temperature compared to the cool process air CA from evaporator 252. As a result, heat energy is transferred to the cool process air CA at the condenser 256, thereby elevating the process air temperature and providing hot dry process air HDA for resupply to laundry basket 120 of laundry appliance 100. The hot dry process air HDA passes over and around laundry articles LA within the chamber 126 of the laundry basket 120, such that warm moisture laden process air MLA is generated, as mentioned above.

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low pressure gas phase. The pressurization of the refrigerant within compressor 254 increases the temperature of the refrigerant. The compressed refrigerant is fed from compressor 254 to condenser 256 through refrigerant line 260. As the relatively cool process air CA from evaporator 252 flows across condenser 256, the refrigerant is cooled and its temperature is lowered as heat is transferred to the process air for supply to chamber 126 of laundry basket 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. Importantly, the flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden process air MLA received from chamber 126 of laundry basket 120. The process is repeated as process air is circulated along process air flow path 232 while the refrigerant is cycled through sealed system 250, as described above.

Returning to FIGS. 2 and 3, conditioning system 200 is fluidly coupled with tub 124, e.g., via condensate line 262. In particular, condensate line 262 provides fluid communication between the evaporator 252 and the sump 124. As discussed above, the evaporator 252 cools and dehumidifies the moisture laden air MLA exiting the chamber 126. As the MLA passes through the evaporator 252, the expanding and relatively colder working fluid in the evaporator cools the MLA and removes condensate water 271 from the MLA air flow. The condensate water 271 is collected at a first end 261 of the condensate line 262 and directed to the tub 124. Condensate line 262 is positioned at the tub 124 such that second end 263 enters the sump 142 at a vertically bottom portion of the tub 124. In this configuration, the sump 142 may hold a quantity of condensate water 271 without the condensate water contacting the laundry basket 120.

Pressure sensor 152 may be operable to sense the pressure of the condensate water 271 in the sump 142 and communicate a corresponding water pressure signal to the controller 166. In an embodiment, the pressure sensor 152 is mounted at the sump 124. In another embodiment, the sump may be fluidly coupled to a pressure sensor via a conduit or tube, with the pressure sensor reactive to the pressure in the tube which corresponds with the depth of water in the sump 124. The controller 166 may process the water pressure signal to determine the depth of the condensate water 271 in the sump 142. At a prescribed upper limit of the condensate water depth, the controller may selectively operate the drain pump 146 to pump a quantity of condensate water to waste 148, which may include a grey water holding tank 282 (e.g., in an RV application). Thus, by sensing the pressure of the condensate water 271 in the sump 142, the controller 166 may cooperate with the drain pump 146 to maintain the condensate water level in the sump at a prescribed depth or within a prescribed range of depths. The depth, or range of depths, of condensate water 271 in the sump 142 is maintained by selectively operating drain pump 146 such that the laundry basket 208 does not contact the surface 284 of the condensate water 271 in the sump 142.

As discussed above, the condensate water 271 is generated when the moisture laden air MLA passes through the evaporator 252 and is dehumidified. Accordingly, the condensate water 271 is produced only during the drying cycle of the laundry cycle. In anticipation of the laundry appliance 100 performing a washing cycle after a drying cycle, the condensate water 271 may be stored in the sump 142 for a predetermined period of time, for example about 6 hours from the end of the drying cycle as determined by the timer in the controller 166. The time period of 6 hours is presented as an example, not a limitation. The condensate water 271 may be stored in the sump 142 for any time period at least long enough to allow removal of the dried laundry load from the laundry basket 120 and loading of a subsequent laundry load for washing. In embodiments, the time period may be limited to prevent organic growth (e.g., mold or mildew) in the condensate water 271 stored in the sump 142. At the expiration of the predetermined time period, the controller 166 selectively operates the drain pump 146 to drain all of the water remaining in the sump 142 to waste 148. Additionally, the time period may be terminated if motion of the RV is detected, for example by an accelerometer signaling the controller 166. If motion of the RV is determined, the controller 166 may signal the drain pump 148 to drain the sump 142 of some or all stored condensate water 271.

Now that the construction of laundry appliance 100 and the configuration of controller 166 according to exemplary embodiments have been presented, an exemplary method 300 of operating a laundry appliance will be described. In exemplary embodiments, the various method steps as disclosed herein may be performed by controller 166 or a separate, dedicated controller.

As briefly described above, combination washer and dryer laundry appliances, such as laundry appliance 100, may have features which make them attractive in settings with limited available space. With some combination washer/dryer appliances, the effectiveness of a full-size washer/dryer pair of appliances may be achieved in substantially the same volume as a single appliance.

Accordingly, combination washer/dryer appliances may be attractive for use in recreational vehicles (RVs) in addition to use in traditional installations. In many RV uses, water conservation is an issue as clean, potable water is limited to the amount that can be carried in a potable water tank. In addition, grey water and black water must be, at times, contained in separate tanks in the RV. Reducing the amount of water used in a laundry operation can be a component of the water conservation efforts in an RV.

In addition to the practical motivation for water conservation in an RV installation of a laundry appliance 100, water conservation may also be desirable for traditional domestic installations. In some areas water resources are scarce, making water conservation a priority. Therefore, aspects of the present disclosure are directed to systems and methods for limiting water use in a laundry operation while maintaining an acceptable level of cleaning.

Figure 5:
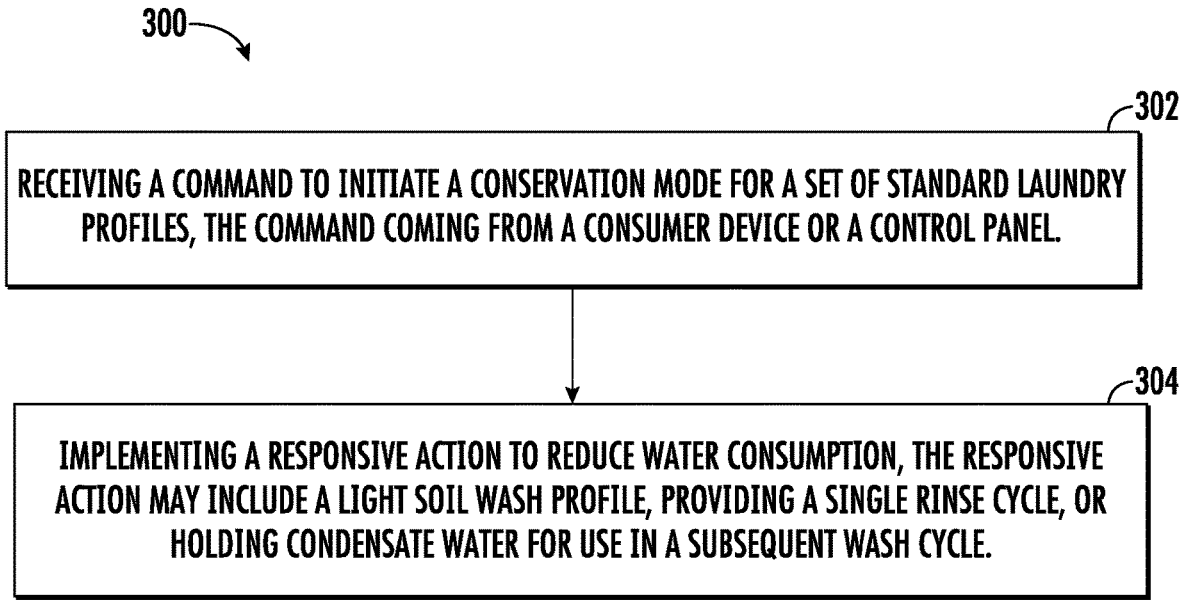
FIG. 5 illustrates a method for operating a laundry appliance in accordance with one embodiment of the present disclosure.

Referring now to FIG. 5, method 300 includes at step 302 receiving a command to initiate a conserving or conservation mode for a set of standard laundry profiles. For example, controller 166 of laundry appliance 100 may receive user input to initiate the conserving mode. It should be appreciated that the command to initiate the conserving mode may be received from any suitable source and in any suitable manner. According to exemplary embodiments, a user may enter the command using a user interface panel, such as user interface panel 160 of laundry appliance 100. In this regard, for example, one of input selectors 162 may be a button, a switch, a rotary dial, a capacitive touch button, a touchscreen, or another mechanical or tactile input that a user may select to initiate the conservation mode. According to still other embodiments, a user may initiate the appliance travel cycle remotely, e.g., using a consumer device 174 such as a cell phone linked to the controller 166. In this regard, a user may enter a mobile software application on a consumer device such as a cellular phone and may enter a command to enter the conservation mode prior to initiating a laundry operation of laundry appliance 100. Other manners of receiving the appliance travel cycle command are possible and within the scope of the present disclosure.

In some embodiments, the standard laundry profiles may, by default, include modifications to a standard laundry profile to add water conserving features. For example, a laundry appliance 100 manufactured specifically for use in an RV may include RV-specific laundry profiles with the described water conserving features as default settings to minimize the use of water in performing a wash cycle. Accordingly, a command to initiate an RV-specific laundry profile initiates a conservation mode for a standard laundry cycle profile.

Method 300 may further include, at step 304, implementing a responsive action to reduce water consumption of the laundry appliance 100. As used herein, the terms "responsive action" and the like are generally intended to refer to any adjustments or manipulations of laundry appliance 100 made by laundry appliance 100 (e.g., as regulated by controller 166), by a user, or by any other interacting force that are intended to modify, i.e., reduce, the water consumption of a standard laundry profile. Here, "standard laundry profile" is intended to mean the factory default profiles which may not have water conservation as a primary feature. Although exemplary responsive actions are described herein, it should be appreciated that these responsive actions are only intended to facilitate discussion of the present subject matter and are not intended to be limiting in any manner. Other responsive actions are possible and within the scope of the present subject matter.

According to exemplary embodiments of the present subject matter, water may be conserved by providing a light soil level wash profile for the laundry load. A light soil level profile may include, or optionally provide, a reduced agitate fill level (i.e., reduced water or wash fluid fill level). In order to achieve acceptable cleaning performance, the modified setting may include extended time for agitation portions of the laundry profile, or additional agitation periods, to account for a reduced volume of water in the tub 124. In other embodiments, the modified setting may include extended or additional dwell or soak periods with no agitation. Other embodiments may modify other standard portions of the laundry profile to provide an appropriate level of cleaning performance.

In another exemplary embodiment, a modification called for by the responsive action of the conservation mode limits one or more standard laundry profiles to a single rinse cycle. Some of the standard laundry cycles may include more than one rinse cycle in which clean water is used to remove wash fluid (i.e., water modified with detergent, softener, etc.). The conservation mode reduces one or more profiles to a single rinse cycle that may be adjusted to achieve an acceptable rinse performance. For example, the dwell or soak time or times may be extended, or the number of dwell periods may be increased in the rinse cycle. In some embodiments, each laundry profile modified to comprise a single rinse cycle is further modified to comprise a spin cycle having at least one of a longer duration and a higher speed (i.e., rotational speed) than the duration and speed of the standard laundry profile. Increasing the duration or rotational speed of the spin cycle, or both, during a final spin cycle removes more soiled wash fluid from the laundry articles, compensating for limiting the laundry profile to a single rinse cycle.

In an embodiment of a responsive action in accordance with the present disclosure, a drying cycle in a conservation mode may hold a volume of condensate water 271 in the sump 142 for use in a subsequent wash cycle (i.e., using the condensate water 271 as at least a portion of the wash fluid in a wash cycle following the drying cycle within a predetermined time). Specifically, condensate line 262 directs a flow of condensate water 271 from the evaporator 252 to the sump 142. The first end 261 of condensate line 262 may be configured to collect condensation as it forms droplets on the evaporator 252, for example on the coils or fins of the evaporator 252. As the condensate water flows to the sump 142, pressure sensor 152 is in operable communication with the controller and communicates a pressure signal to the controller 166 corresponding to the depth of the condensate water 271 in the sump 142. The controller 166 selectively operates the drain pump 146 to maintain a condensate water level at or below a predetermined maximum condensate water level. The maximum water level is selected such that the surface 284 of the condensate water 271 does not contact the laundry basket 120 which may contain a laundry load of dried laundry articles.

In some embodiments, the controller 166 may activate the drain pump 146 to drain the condensate water 271 in the tub 124 if the condensate water has remained in the tub beyond a predetermined period of time. Expiration of the predetermined period of time may be interpreted by the controller 166 as indicating that no subsequent wash cycle will be following the drying cycle. Pumping the unused condensate water 271 from the tub 124 may lessen the likelihood of excessive moisture buildup in the tub during a period of non-use.

The user may override some or all of the modifications discussed above, for example with manipulations of the input selectors 162 at the control panel 160 or through input at the consumer device 174. For example, a user may input a command to the controller overriding one or more of the default conserving settings (i.e., the set of default profiles modified by the conservation mode) to operate a laundry cycle deemphasizing water conservation. Similarly, a user may modify a standard laundry profile with a water conservation mode by selectively manipulating the input selectors 162 or through the consumer device 174.

FIG. 5 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 300 are explained using a particular combination washer and dryer laundry appliance 100 as an example, it should be appreciated that these methods may be applied to the operation of any suitable washer, dryer, or combination laundry appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A laundry appliance comprising:

a tub positioned within a cabinet;

a laundry basket supported for rotation within the tub, the laundry basket defining a chamber for receipt of laundry articles for washing and drying;

a conditioning system comprising a dehumidification section and a heating section;

a recirculating process air flow system providing fluid communication between the chamber and the conditioning system, wherein the recirculating process air flow system, the conditioning system, and the laundry basket define a process air flow path;

a fan operable to move a flow of process air through the process air flow path;

a condensate line;

a drain pump fluidly coupling a sump with a waste; and a controller storing a set of standard laundry profiles, the controller configured to:

receive a command to initiate a conservation mode for modifying the set of standard laundry profiles; and implement a responsive action to reduce water consumption of the laundry appliance, wherein the condensate line fluidly couples the conditioning system with a bottom portion of the tub, and wherein the responsive action comprises:

directing a flow of condensate water to the tub using the condensate line;

holding a volume of condensate water in the sump; and using the condensate water in the sump for at least a portion of a wash fluid of a subsequent wash cycle.

2. The laundry appliance of claim 1, wherein the command is received by the controller from one or more of an input selector operatively coupled to the laundry appliance and a consumer device.

3. The laundry appliance of claim 2, wherein the consumer device is linked to the controller through one of a direct link and a network link.

4. The laundry appliance of claim 1, further comprising:

a pressure sensor configured to sense a level of condensate water in the sump, the pressure sensor in operable communication with the controller; and the controller is further configured to receive a signal from the pressure sensor corresponding to the level of condensate water in the sump; and wherein the responsive action comprises selectively operating the drain pump.

5. The laundry appliance of claim 4, wherein the responsive action further comprises selectively operating the drain pump to maintain a condensate water level at or below a predetermined maximum condensate water level.

6. The laundry appliance of claim 4, wherein the responsive action further comprises:

selectively operating the drain pump to pump the condensate water in the sump to waste at an expiration of a predetermined time period.

7. The laundry appliance of claim 1, wherein the responsive action comprises modifying a default setting for the set of standard laundry profiles to a default conserving setting of light soil level and a reduced water fill level.

8. The laundry appliance of claim 7, wherein the controller is further configured to receive a command overriding the default conserving setting.

9. The laundry appliance of claim 1, wherein implementing the responsive action comprises modifying the set of standard laundry profiles such that each laundry profile comprises a single rinse cycle.

10. The laundry appliance of claim 9, wherein each laundry profile comprising a single rinse cycle is further modified to comprise a spin cycle having at least one of longer duration and higher speed than the standard laundry profile.

11. The laundry appliance of claim 1, wherein the command is received by the controller from one or more of a consumer device and a control panel on the laundry appliance.

12. A method of operating a laundry appliance, the laundry appliance comprising a tub positioned within a cabinet, a laundry basket supported for rotation within the tub, a drain pump fluidly coupling a sump with a waste, a conditioning system comprising a dehumidification section, a condensate line fluidly coupling the conditioning system with the tub, and a controller storing a set of standard laundry profiles and configured to perform the set of standard laundry profiles, the method comprising:

receiving a command to initiate a conservation mode for the set of standard laundry profiles; and implementing a responsive action to reduce water consumption of the laundry appliance, the responsive action comprising:

directing a flow of condensate water to the tub using the condensate line;

holding a volume of condensate water in the sump; and using the condensate water in the sump for at least a portion of a wash fluid of a subsequent wash cycle.

13. The method of claim 12, wherein the method further comprises:

receiving, at the controller, a signal from a pressure sensor, the signal corresponding to a level of condensate water in the sump; and selectively operating the drain pump in response to the signal.

14. The method of claim 13, wherein selectively operating the drain pump comprises operating the drain pump to maintain the level of condensate water in the sump at or below a predetermined maximum condensate water level.

15. The method of claim 13, wherein the method further comprises selectively operating the drain pump to pump the condensate water from the sump to waste at an expiration of a predetermined time period.

16. The method of claim 12, wherein the responsive action further comprises:

modifying a default setting for the set of standard laundry profiles to a default conserving setting of light soil level and a reduced water fill level.

17. The method of claim 12, wherein the responsive action comprises modifying the set of standard laundry profiles such that each laundry profile comprises a single rinse cycle.

18. The method of claim 17, wherein each laundry profile comprising a single rinse cycle is further modified to comprise a spin cycle having at least one of longer duration and higher speed than the standard laundry profile.

* * * * *